US006226955B1

(12) United States Patent
Lorrigan

(10) Patent No.: US 6,226,955 B1
(45) Date of Patent: May 8, 2001

(54) METHOD AND APPARATUS FOR HANDLING BUILDING MATERIALS AND IMPLEMENTS

(76) Inventor: Jerry L. Lorrigan, 313 Tacoma Blvd., S. Pacific, WA (US) 98047

( * ) Notice: Subject to any disclaimer, the term of this patent is extended or adjusted under 35 U.S.C. 154(b) by 0 days.

(21) Appl. No.: 09/352,556

(22) Filed: Jul. 13, 1999

Related U.S. Application Data

(63) Continuation-in-part of application No. 09/221,618, filed on Dec. 28, 1998.

(51) Int. Cl.[7] ..... E04G 21/04

(52) U.S. Cl. ..... 52/745.05; 212/179; 212/270; 264/34; 414/10

(58) Field of Search ..... 212/175, 176, 212/177, 199, 200, 201, 202, 203, 270, 179; 264/33, 34; 414/10; 52/745.05

(56) References Cited

U.S. PATENT DOCUMENTS

| | | | | |
|---|---|---|---|---|
| 1,175,049 | * | 3/1916 | Cull | 212/202 |
| 3,481,489 | | 12/1969 | Stauffer | 212/55 |
| 3,656,631 | * | 4/1972 | Rauch et al. | 212/230 |
| 3,976,092 | | 8/1976 | Coja et al. | 137/343 |
| 3,985,234 | | 10/1976 | Jouffray | 212/144 |
| 4,180,170 | | 12/1979 | Meinken | 212/1 |
| 4,856,662 | * | 8/1989 | Marvin et al. | 212/177 |
| 5,462,907 | * | 10/1995 | Franklin | 212/175 |

FOREIGN PATENT DOCUMENTS

| | | | | |
|---|---|---|---|---|
| 682443 | * | 8/1979 | (SU) | 212/175 |
| 1150215 | * | 4/1985 | (SU) | 212/176 |

* cited by examiner

*Primary Examiner*—Thomas J. Brahan
(74) *Attorney, Agent, or Firm*—Delbert J. Barnard

(57) ABSTRACT

A telescopic turret crane (126) is detachably connectable to a pedestal (118) that is incorporated into a concrete building structure that is under construction. The telescopic turret crane is provided with a base (122) that is detachably connected to the pedestal (118). The same pedestal (118) is sometimes used for supporting an articulated concrete placement boom (126). This boom (126) includes the similar base that is detachably connectable to the same pedestal (118). The concrete placement boom (126) is attached to the pedestal (118) and is used to pour a new upper floor in the building. Following this use, the articulated concrete placement boom (126) is detached from the pedestal (118) and is moved away from the pedestal (118). Then, the telescopic turret crane is brought to the pedestal (118) and is connected to the pedestal (118). The telescopic turret crane is used during the performance of tasks on or above the newly poured floor, in the vicinity of the pedestal (118). This includes erecting forms better used for forming columns and walls on the floor. Following this use, the telescopic turret crane (132) is detached from the pedestal (118) and is moved away from the pedestal (118). The articulated concrete placement boom (126) is returned and is again attached to the pedestal (118). It is then used for pouring the columns and walls and then constructing another new floor above the last one.

3 Claims, 4 Drawing Sheets

METHOD AND APPARATUS FOR HANDLING BUILDING MATERIALS AND IMPLEMENTS

RELATED APPLICATION

This is a continuation-in-part of Ser. No. 09/221,618, filed Dec. 28, 1998, and entitled Pocket Crane For Use In Making Multi-Story Reinforced Concrete Building Structure.

TECHNICAL FIELD

This invention relates to material handling and, more particularly, to methods and apparatus for distributing concrete and handling other materials and implements, during the construction of a multi-story reinforced concrete structure.

BACKGROUND OF THE INVENTION

In the construction of a reinforced concrete building, a floor is constructed, then columns and walls are constructed on that floor for supporting the next floor above it, then the next floor is constructed, and so on. Conventional practice is to erect a main crane at the center or approximate center of the building site, to be used for lifting equipment and materials up to each floor as it is added to the building. One of the pieces of equipment that is lifted and used is called a placing boom. It is a principal part of a placing boom assembly that also includes a pump for concrete and tubing through which the concrete is pumped. The placing boom is an articulated boom that supports and handles the tubing. The articulated boom is maneuvered to deliver concrete where a floor, wall or column, etc. is being constructed.

U.S. Pat. No. 3,976,092, granted Aug. 24, 1976, to Joachim Coja, Karl-Ernest von Dckardseein and Bernhard Meinker, and entitled Apparatus For The Distribution Of Concrete, and U.S. Pat. No. 4,180,170, granted Dec. 25, 1979, to Bernhard Meinker, and entitled Rotary Tower Crane For Construction Purposes With A distributor Device For Concrete, both disclose supporting an articulated concrete placement boom on the main crane. U.S. Pat. No. 3,976,092 positions an articulated concrete placement boom at an end of a horizontal boom that is on top of support tower. Pat. No. 4,180,170 discloses supporting the articulated concrete placement boom on the tower below the horizontal boom.

FIG. 4 herein is a copy of FIG. 1 in U.S. Pat. No. 4,180,170. This figure includes the reference numerals that are used in the patent. Reference is made to the patent for a detailed description of the structure shown by the patent and in part shown by FIG. 4 herein. FIG. 5 herein is FIG. 2 in U.S. Pat. No. 3,976,092. The reference numerals used in this figure are the same reference numerals that are used in the patent. Reference is made to the patent, for a detailed description of the structure that is disclosed by the patent and partially disclosed by FIG. 5 herein.

It is also known to mount an articulated concrete placing boom on top of a vertical mast that extends through aligned openings in two or more floors in the building, or is mounted on a side of the building by use of brackets, or is mounted on top of the tower that supports the main crane. A typical mast-mounted articulated concrete placement boom is manufactured by Schwing America, Inc., of White Bear, Minn. 55127. Descriptions of the Schwing articulated concrete placement boom and mounting tower arrangements are disclosed in am issue of Concrete Construction Magazine, copyrighted by The Aberdeen Group of Addison, Ill. 60101.

A reprint of this article is a part of the file of this patent document. In the article, there is a description of the construction of a fourteen story housing project in which there was a need to build one floor per week. The first three floors of this building were placed from the ground with an articulated concrete placement boom that was mounted on a truck. As additional floors were added, workman anchored boom masts in openings in floors that are below the floor that is under construction. Articulated concrete placement booms were mounted on the masts. Then, with two booms working at once, crews constructed the rest of the floors. As soon as a concrete floor became set, forming crews returned to form up walls and columns. Then concrete was pumped to pour these walls and columns. Then, the support mast and placement boom were moved upwardly to be used for pouring the next floor.

According to conventional practice, at the completion of a floor, the main crane is used for lifting the materials and implements that are used for constructing the columns and walls that must be built before the support mast and the placement boom can be raised and repositioned for use in constructing the next floor. Experience has established the fact that the requirements for the service of the main crane exceed the capabilities of a standard work day. The result is overtime work for the main crane and all of the workmen that are associated with it. This overtime work is unacceptably expensive. Accordingly, the primary object of the present invention is to provide a method and apparatus which can eliminate the need for overtime use of the main crane at a cost that is small in comparison to the cost of the overtime usage of the main crane.

The present invention utilizes a telescopic turret crane that is normally mounted on a rear end portion of a truck. A suitable telescopic turret crane for use in practicing the present invention is the Model USTC 28L crane that is made and sold by USTC, Inc., of York Pa. 17401. A six page, three leaf brochure directed to USTC 28L crane is a part of the file of this patent document. Another prior art telescopic turret crane is disclosed by U.S. Pat. No. 3,985,234, granted Oct. 12, 1976, to Maurice Jouffray, and entitled Telescopic Boom For A Crane. FIG. 6 herein is FIG. 1 in Pat. No. 3,985,234. In FIG. 6, the reference numerals are the same reference numerals that are used in the patent. Reference is made to the patent for a full description of the crane that is disclosed by the patent and partially disclosed by FIG. 6 herein. A further prior art telescopic turret crane is disclosed by U.S. Pat. No. 3,481,489, granted Dec. 2,1969, to Robert E. Stauffer, and entitled Means For Extended And Retracting Boom Sections Of A Crane.

A principal object of the present invention is to provide a method of interchangeably using an articulated concrete placement crane and a telescopic turret crane for expediting the construction of a building and reducing the demand on the main crane.

BRIEF SUMMARY OF THE INVENTION

The present invention includes using a telescopic turret crane during the construction of a multi-story reinforced concrete building. A method of the invention is basically characterized by providing the building structure with a support pedestal. A telescopic turret crane is brought to the building site. The crane includes a base, a turret above the base and a telescopic crane boom above the turret. The telescopic crane boom is connected by the turret to the base for rotation about a vertical axis. According to the invention, the telescopic turret crane is brought to the pedestal and the base of the telescopic turret crane is attached to the pedestal. Then, the telescopic turret crane is used to form some construction tasks in the region of the pedestal. Following such use, the base of the telescopic turret crane is detached from the pedestal. Then, the telescopic turret crane is picked up and removed from the pedestal. It is placed elsewhere while some other construction tasks are being performed in the region of the pedestal.

In preferred form, the construction of the building structure includes constructing a first floor and a second floor above it. Vertically aligned openings are provided in the two floors. A vertical support mast is positioned in the aligned openings and is anchored to the building structure. The pedestal is at the top of the vertical support mast.

According to an aspect of the invention, when it comes time to construct a third floor above the second floor, the telescopic turret crane is disconnected from the pedestal and is carried away from the pedestal. Then, an articulated concrete placement boom is brought to the pedestal. Next, a base portion of the articulated concrete placement boom is detachably connected to the pedestal. Then, a third floor is constructed above the second floor. During this construction, the articulated concrete placement boom is used to distribute concrete to pour the third floor. After the third floor has been poured, the articulated concrete placement boom is detached from and moved away from the pedestal. The telescopic turret crane is brought back to the pedestal and its base is again secured to the pedestal. Then, the telescopic turret crane is used for lifting and moving materials and implements that are used for constructing columns, walls, etc. in the region of the pedestal.

A telescopic turret crane embodying the invention comprises a base, a turret above the base to which the base is connected, a main frame above the turret connected to the turret, and a telescopic crane boom above the main frame, connected to the main frame. The base includes a coupler component that is adapted to be detachably connected to a pedestal that is incorporated into the building structure under construction.

In preferred form, the telescopic turret crane further comprises a pivot connection between the base section of the telescopic crane boom and the main frame. An extensible-retractable hydraulic actuator is connected between a location on the main frame below the pivot and a location on the base section of the telescopic crane boom that is spaced from the pivot. The hydraulic actuator serves to swing the telescopic crane boom up and down about the pivot.

Preferably, when the telescopic turret crane is not being used, its base is coupled to a different support pedestal. This additional support pedestal may also be incorporated into the building under construction, at a different location in the building structure. Or, it may be built into a truck or other vehicle that will serve for transporting the telescopic turret crane. Or, it may be a separate immobile structure that is provided simply to serve as a mount for the telescopic turret crane when it is not in use. When the pedestal is mounted on the truck or other vehicle, it is preferably positioned and mounted in such a way that it can be used for performing other tasks away from the building under construction.

Other objects, advantages and features of the invention will become apparent from the description of the best mode set forth below, from the drawings, from the claims and from the principles that are embodied in the specific structures that are illustrated and described.

BRIEF DESCRIPTION OF THE SEVERAL VIEWS OF THE DRAWING

In the drawings, like reference numerals and letters refer to like parts throughout the several views, and.

DETAILED DESCRIPTION OF THE INVENTION

Figures 1, 2, 3:
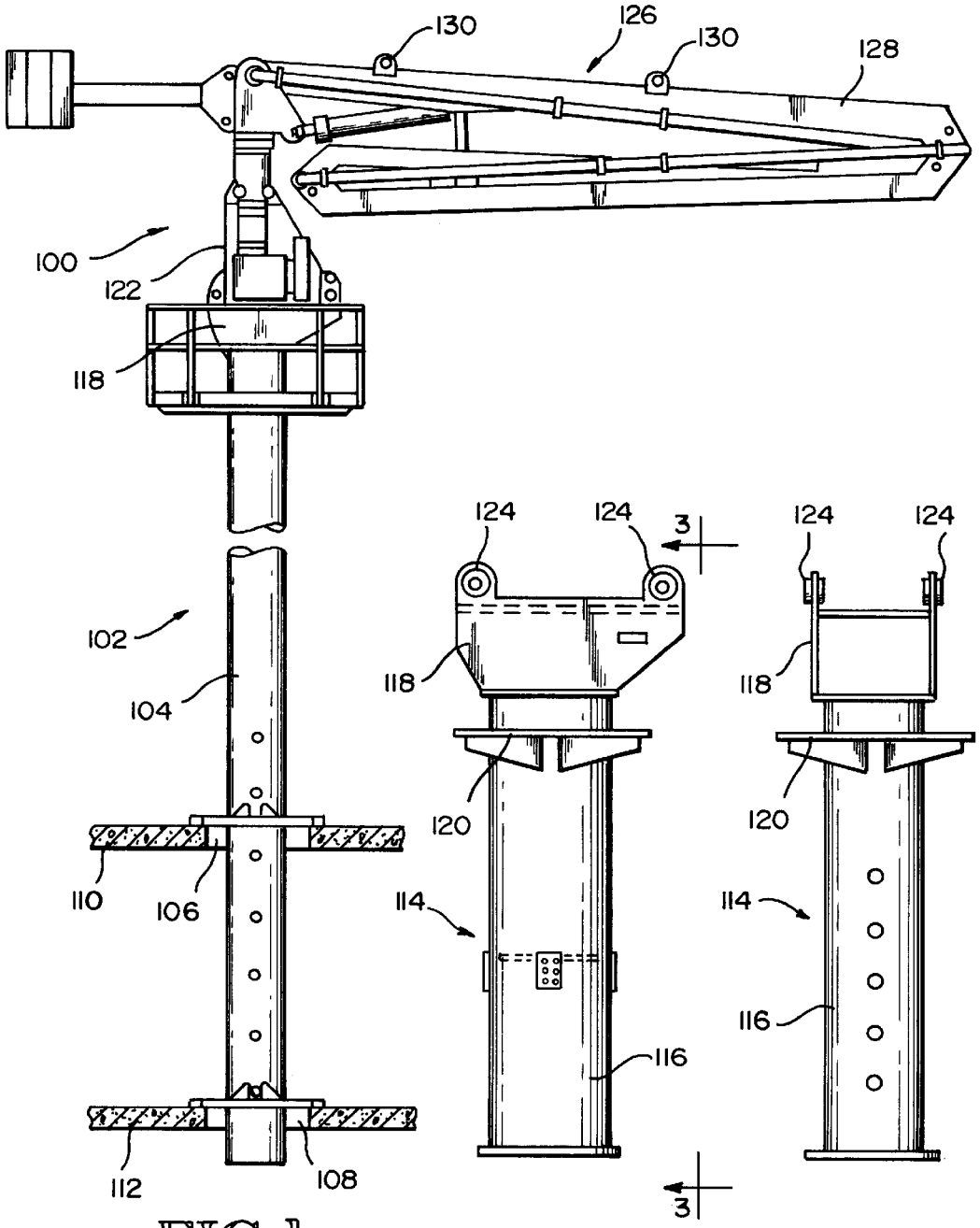
FIG. 1 PRIOR ART
FIG. 2 PRIOR ART
FIG. 3 PRIOR ART
FIG. 1 is a side elevational view of a conventional assembly of an articulated concrete placement boom and support mast that extends through openings in an upper floor in a building and the floor immediately below it, such view showing the mast broken away intermediate its length, for the purpose of indicating indeterminate length.
FIG. 2 is an enlarged scale side elevational view of an upper portion of the mast shown in FIG. 1.
FIG. 3 is a side elevational view of the portion of the mast that is shown by FIG. 2, FIG. 3 being taken substantially along 3—3 of FIG. 2.

FIGS. 1–3 show a prior art system comprising an articulated concrete placement boom assembly 100 mounted on top of an elongated vertical support member 102 that is herein referred to as a "mast." As shown by FIG. 1, a lower portion 104 of the mast 102 extends through openings 106 and 108 in vertically spaced apart floors 110, 112 that are a part of a building that the articulated concrete placement crane 100 is being used to build. The upper portion 114 of the mast 102 is shown by FIGS. 2 and 3. It includes a tubular body 116 and a pedestal 118 at its upper end. Preferably, a support bracket 120 is secured to the body 116 below the pedestal 118.

Pedestal 118 is a lower major component of a coupler that includes a second major component 122 that is a part of a base for the articulated concrete placement boom 100. The particular coupler illustrated has four corner located connector pin receiving eyes 124. Corresponding eyes are provided on the base 122. When the base 122 is set down onto the pedestal 118, the eyes in the base 122 are in alignment with the eyes 124 in the pedestal 118. Pins are inserted through the aligned eyes for firmly attaching the base 122 to the pedestal 118. This coupler structure provides a way of detachably connecting the articulated concrete placement boom 100 to the support mast 102.

Figure 4:
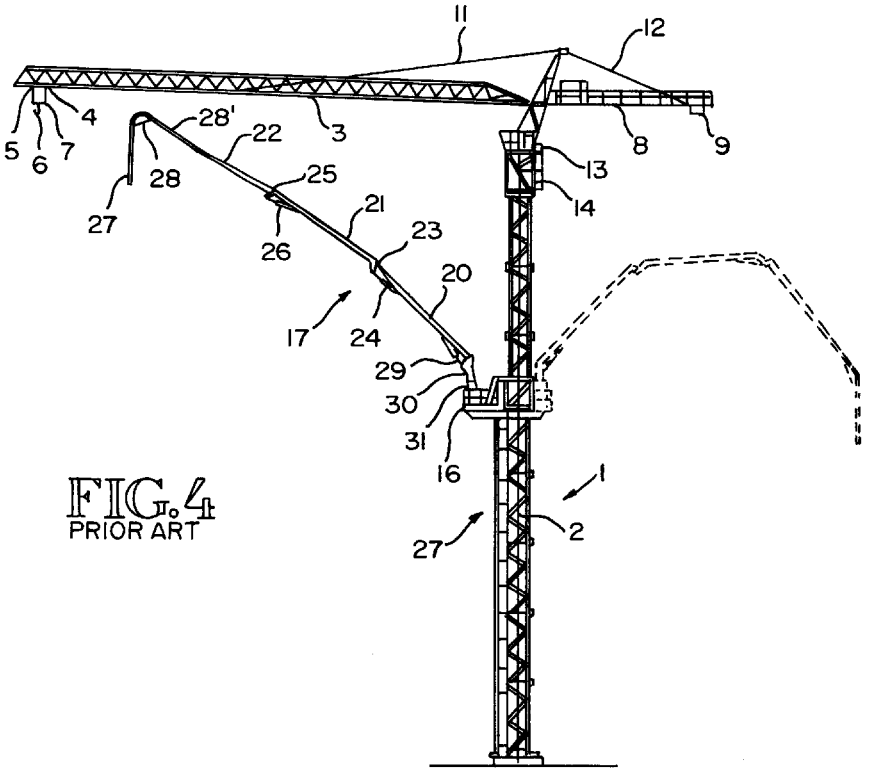
FIG. 4 PRIOR ART
FIG. 4 is a copy of FIG. 1 of the aforementioned U.S. Pat. No. 4,180,170, such view showing a main crane having a main horizontal boom at its top and an articulated concrete placement boom mounted on the tower below the main boom.
Figure 5:
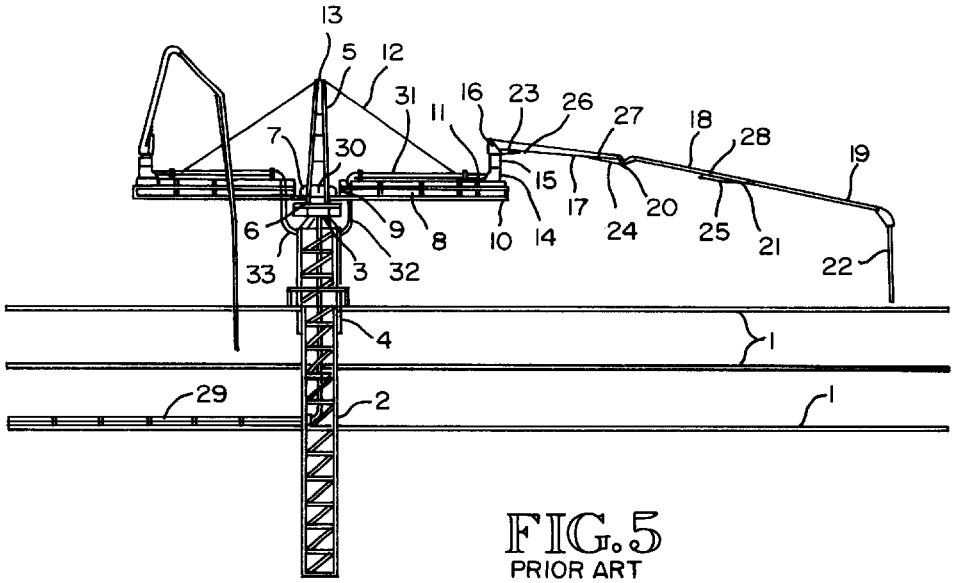
FIG. 5 PRIOR ART
FIG. 5 is a view like FIG. 2 of the aforementioned U.S. Pat. No. 3,976,092, such view showing two articulated concrete placement booms mounted on opposite ends of a horizontal main boom that extends outwardly an opposite direction from the tower, such view showing two positions of the articulated concrete placement boom.
Figure 7:
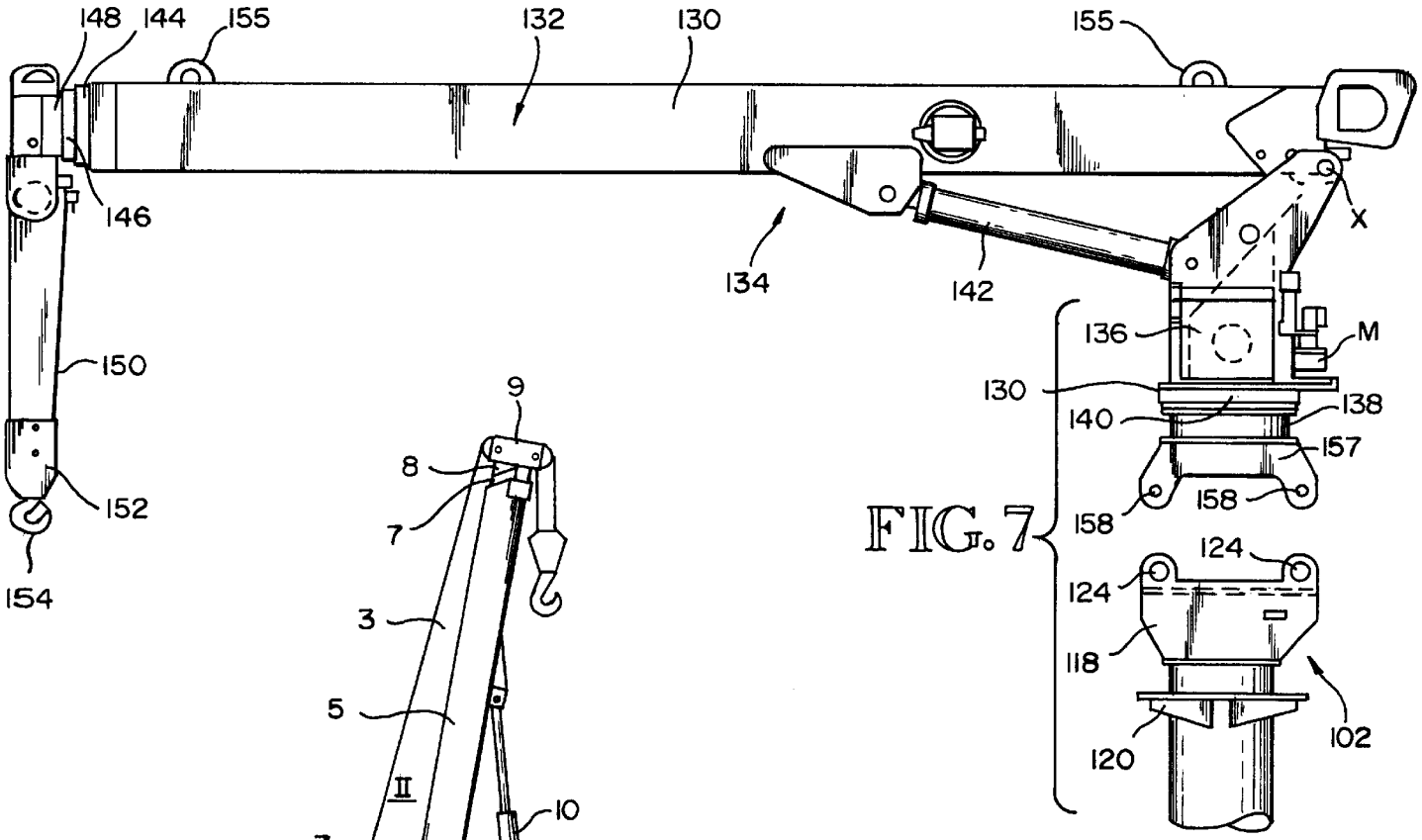
FIG. 7 is an exploded isometric view of a telescopic turret crane spaced above the upper end of a tower or mast, such view showing one component of a four pin coupler at the base of the turret and the second component of the four pin coupler at the upper end of the mast.

FIGS. 4 and 5 show an articulated concrete placement boom but in a different setting. FIG. 4 shows the boom 17 mounted on a platform 16 that in turn is connected to a mast or tower 1. FIG. 5 shows the articulated concrete placement boom mounted on a base 14 that is in turn mounted on an outer end portion of a horizontal boom. FIG. 1 shows the articulated concrete placement boom 126 mounted on the pedestal 122. FIG. 1 shows the boom 126 in a folded position. It further shows a base section 128 of the boom that is provided with a pair of spaced apart pick up eyes 130. The boom 126 is picked up and moved when in its folded condition. A pick up bridle (not shown) is connected to the pick up eyes 130. Bridle legs lead up from the eyes 130 to a main cable (not shown) which is used for picking up and moving the boom 126.

Figure 6:
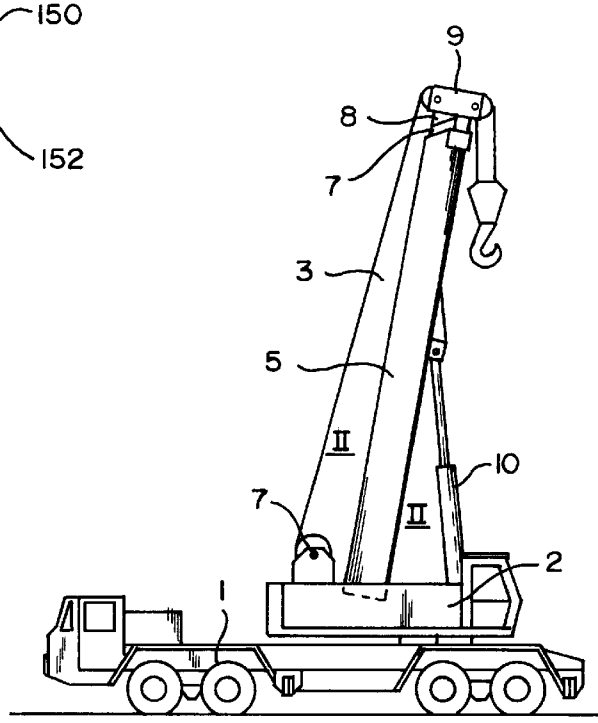
FIG. 6 PRIOR ART
FIG. 6 is identical to FIG. 1 in the aforementioned U.S. Pat. No. 3,985,234, such view showing one position of one embodiment of a known telescopic turret crane.

FIG. 6 shows a typical prior art telescopic turret crane. It is mounted on a chassis 1 by a rotatable turret 2. A telescopic boom 3 is connected at its base to the turret 2. The crane includes a telescopic boom 3 that is composed of four elements: a base element 5 pivoted at 6 on the turret 2 and three telescopic elements 7, 8, 9. The inclination of the boom 3 is adjusted by a hydraulic actuator 10, that is pivotally connected at one end of the turret 2 and at its opposite end to the base section 5 of the boom.

According to the present invention, the base section 130 of the boom 132 of a telescopic turret crane 134 is connected to a main frame 136 of the telescopic turret crane 132. Main frame 136 is connected to a base 138 by a rotatable turret 140. Main frame structure 136 supports a drive motor M that engages a movable portion of the turret 140 and causes rotation of the main frame 136 relative to the base 138. A double acting hydraulic piston-cylinder unit 142 is extended and retracted to cause the boom 132 to move up and down in a vertical plane about axis x. The outermost section 148 of the boom 132 carries a cable 150 and a pick up hook 152 that is at the lower end of a housing structure 155. This is all prior art structure per se and thus it does not need to be described further.

According to an aspect of the invention, the base section or main section 130 of the boom 132 is provided with pick up eyes 155 that are used together with a pick up bridle (not shown), when it is desired to pick up the telescopic turret crane and either move it to or away from the support mast 102. According to the invention, the base 138 is provided with a coupler part 157 that is like the coupler part on the articulated concrete placement boom 136. It includes four corner placed eyes 158 that are alignable with eyes 124 provided on the pedestal 118, so that the same or same type of, coupler pins can be used for connecting the base 138 of the telescopic turret crane to the pedestal 118 as is used for connecting the base of the articulated concrete placement boom 126 to the pedestal 118.

The support bracket 120 on the support mast 102 may be used for supporting a work platform 164 for workman. Platform 164 is surrounded by guardrail 166.

Figure 8:
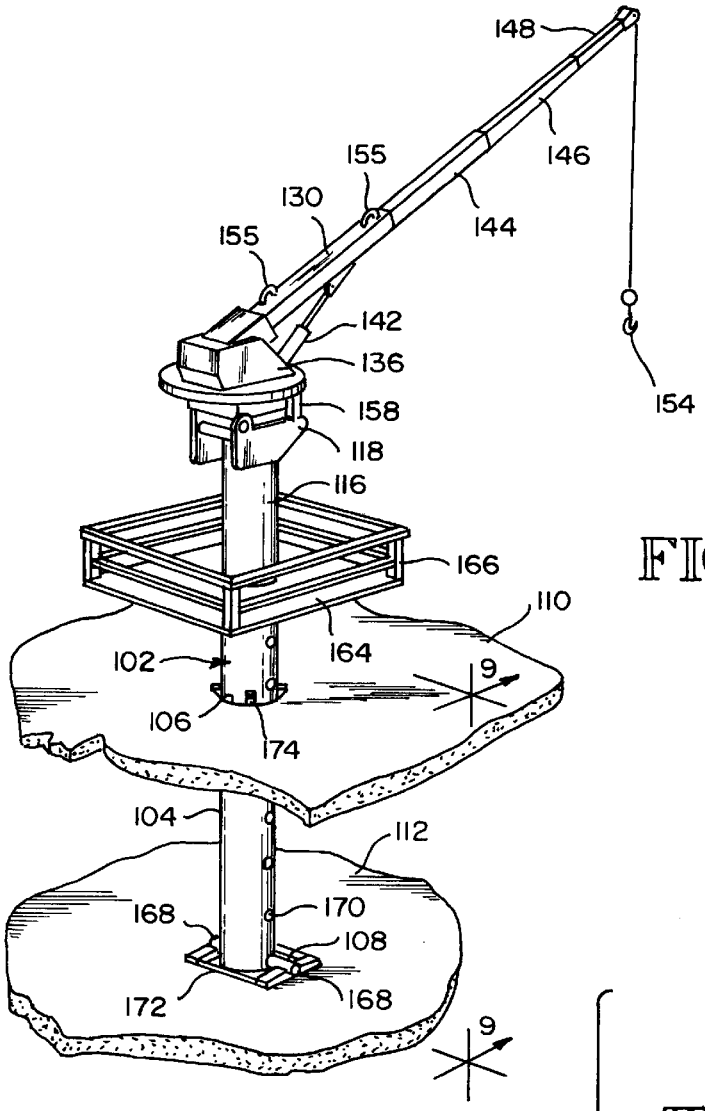
FIG. 8 is a pictorial view of the telescopic turret crane shown by FIG. 7, positioned on top of a mast that is adapted to support either the telescopic turret crane or an articulated concrete placement boom.
Figure 9:
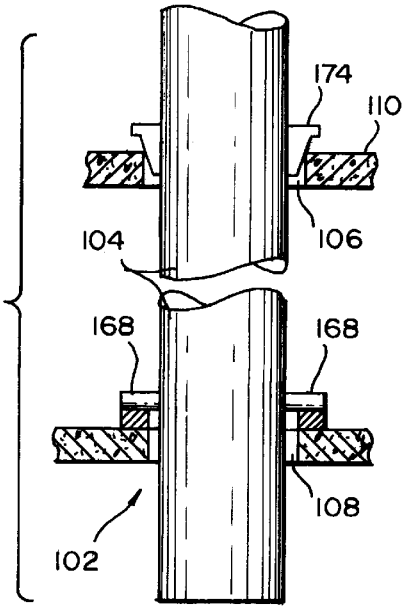
FIG. 9 is a vertical sectional view taken substantially along line 9—9 of FIG. 8, with an intermediate portion of the mast broken away to indicate indeterminate length.

FIGS. 8 and 9 show the support mast 102 positioned within openings 106, 108 in the floors 110, 112. A pin 168 extends through a selected pair of openings 170 provided in the lower portion 104 of the support mast 102. The opposite end portions of the pin 108 are received in cradles that are a part of a structure 172 that is secured to the floor 112. The tube body 104 loosely fits in the openings 106, 108. Preferably, it is stabilized by a set of wedges 174. When the wedges 174 are within the opening 106, their lower portions extend downwardly into the opening. The wedges 174 have upper portions that extend radially from the support mast body 104 to a position outwardly beyond the periphery of the opening 106. This is shown in FIG. 9. The shape of the wedges 174 keeps them from falling through the annular space that is formed by and between the mounting mast body 104 and the inner periphery of the opening 106.

The first few floors of the building may be constructed in the conventional manner, utilizing an articulated concrete placement boom that is mounted on a truck. After some floors have been constructed in this manner, the support mast 102 is placed in openings 106, 102 formed in two adjacent floors 110, 112, as previously described. Then, the articulated concrete placement boom 126 is mounted onto the pedestal 118. Throughout the construction of the building, one or the other of the articulated concrete placement boom and the telescopic turret crane is connected to the pedestal 118, is used, and is then replaced by the other. For example, let it be assumed that the articulated concrete placement boom is first to be attached to the pedestal 118. Following attachment, the boom is unfolded and used to pour concrete to form a floor of the building. Following completion of a current need for the articulated concrete placement boom, it is folded back into the position shown by FIG. 1. The ends of a pick up bridle (not shown) are connected to the pick up eyes 130. The coupler pins are removed so as to separate the base of the placement boom from the pedestal 118. Then, the bridle (not shown) is picked up by a suspension line (not shown) so as, to pick up the placement boom 100 and carry it away from the pedestal 118. Then, the same line and bridle, or a different line and bridle, are used to pick up the telescopic turret crane and carry it to a position where its base 138 can be connected to the pedestal 118. The eyes 158 on its coupler structure 156 are aligned with the eyes 124 at the corners of the pedestal 118. Then connector pins are inserted through the aligned eyes for connecting the telescopic turret crane to the pedestal 118. The telescopic turret crane is then used for various tasks in the region of the pedestal 118. These tasks include picking up and placing forms for columns and walls that are to be supported by the floor that was then constructed. The telescopic turret crane can also be used to pick up and move various tools and implements that are used in the construction process. Then, when it is desired to pour more concrete, the pick up line and pick up bridle are returned and are connected to the pick up eyes 155. The coupler pins are removed and the pick up line and bridle are both upwardly to lift the telescopic turret crane up off of the pedestal 118. The lifting equipment is used to move the telescopic turret crane wherever it is to be used next, or is to be stored. Then, the articulated concrete placement boom is returned, reattached to the pedestal 118, and is used for pouring more concrete.

According to an aspect of the invention, one or both of the articulated concrete placement boom and the telescopic turret crane is provided with a dedicated carrier. When not being used, the articulated concrete placement boom is mounted on its carrier, preferably by use of the coupler at its base and a second coupler element that is like pedestal 118 and is on the carrier. When the telescopic turret crane is not being used, it may also be mounted onto its carrier vehicle, such as by use its coupler part 157 and the part on the vehicle that is like pedestal 118. Providing this type of detachable connection between the telescopic turret crane and its carrier enables the telescopic turret crane to be used in a normal fashion from the carrier, such as the aforementioned model USTC 28L crane is used.

The illustrated embodiments are only examples of the present invention and, therefore, are non-limitive. It is to be understood that many changes in the particular structure, materials and features of the invention may be made without departing from the spirit and scope of the invention.

Therefore, it is my intention that my patent rights not be limited by the particular embodiments illustrated and described herein, but rather determined by the following claims, interpreted according to accepted doctrines of claim interpretation, including use of the doctrine of equivalents and reversal of parts.

What is claimed is:

1. A method of constructing a building structure, comprising:

constructing a first floor and a second floor above it;

providing vertically aligned openings in the two floors;

providing a vertical support mast and positioning it in the aligned openings and anchoring it to the building structure;

providing a telescopic turret crane that has a base, a turret above the base and a telescopic crane boom above the turret that is connected by the turret to the base for rotation about a vertical axis;

detachably connecting the base of the telescopic turret crane to a top portion of the support mast;

using the turret to swing the telescopic boom about a vertical axis;

using the telescopic boom for picking up and moving materials during further construction of the building;

following such use of the telescopic boom;

detaching the base of the telescopic turret crane from the upper end portion of the support mast;

removing the telescopic turret crane away from the support mast;

providing an articulated concrete placement boom having a base;

detachably connecting the base of the articulated concrete placement boom to the upper end portion of the support mast;

constructing a third floor above the second floor, including using the articulated concrete placement boom to distribute concrete to make the third floor;

providing the vertical support mast with an upper end and a first component of a detachable connection at its upper end;

providing the base of the telescopic turret crane with a complementary second component of the detachable connection;

providing the base of the articulated concrete placement boom with a third component that is also complementary to the first component; and wherein the second and third components are selectively and alternatively detachably connectable to the first component for selectively connecting the telescopic turret crane and the articulated concrete placement boom to the top of the pedestal.

2. The method of claim 1, further comprising providing a pair of spaced apart pickup eyes on the telescopic crane boom, and connecting a pickup bridle to these pickup eyes, lifting up on the bridle to in turn lift the telescopic turret crane, and moving the turret crane away from the support mast.

3. A method of constructing a building structure, comprising:

providing the building structure with the support pedestal;

providing a telescopic turret crane that has a base, a turret above the base and a telescopic crane boom above the turret that is connected by the turret to the base for rotation about a vertical axis;

transporting the telescopic turret crane to the pedestal and attaching the base of the telescopic turret crane to the pedestal;

using the telescopic turret crane to perform some construction tasks in the region of the pedestal, including rotating and extending and retracting the crane boom during such use;

following such use, detaching the base of the telescopic turret crane from the pedestal;

picking up the telescopic turret crane and removing it from the pedestal, and placing it elsewhere while some other construction tasks are being performed in the region of the pedestal;

providing an articulated concrete placement boom having a base;

transporting the articulated concrete placement boom to the pedestal at a time when the telescopic turret crane is not connected to the pedestal;

detachably connecting the base of the articulated concrete placement boom to the pedestal;

constructing a new part of the building structure, using the articulated concrete placement boom to distribute concrete that is used in the construction;

following such construction of the new part of the building structure, detaching the base of the articulated concrete placement boom from the pedestal;

picking up the articulated concrete placement boom and removing it from the pedestal, and placing it somewhere else;

returning the telescopic turret crane to the pedestal and connecting its base to the pedestal; and using the telescopic turret crane again to perform some construction task in the region of the pedestal.

* * * * *